US010562304B2

(12) United States Patent
Feinn et al.

(10) Patent No.: US 10,562,304 B2
(45) **Date of Patent: *Feb. 18, 2020**

(54) NONCIRCULAR INKJET NOZZLE

(71) Applicant: HEWLETT-PACKARD DEVELOPMENT COMPANY, L.P., Houston, TX (US)

(72) Inventors: James A. Feinn, San Diego, CA (US); Albert Nagao, Corvallis, OR (US); Thomas R. Strand, Corvallis, OR (US); David R. Thomas, Corvallis, OR (US); Erik D. Torniainen, Corvallis, OR (US); Lawrence H. White, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/139,716

(22) Filed: Sep. 24, 2018

(65) Prior Publication Data

US 2019/0023010 A1 Jan. 24, 2019

Related U.S. Application Data

(63) Continuation of application No. 13/386,866, filed as application No. PCT/US2010/029450 on Mar. 31, 2010, now Pat. No. 10,112,393.

(51) Int. Cl.
*B41J 2/14* (2006.01)

(52) U.S. Cl.
CPC ..... *B41J 2/1433* (2013.01); *B41J 2/14016* (2013.01); *B41J 2002/14387* (2013.01); *B41J 2002/14475* (2013.01); *B41J 2202/11* (2013.01)

(58) Field of Classification Search
CPC ..... B41J 2/1433; B41J 2/14016; B41J 2002/14387; B41J 2/14475; B41J 2/11
(Continued)

(56) References Cited

U.S. PATENT DOCUMENTS 6,123,413 A 9/2000 Agarwal et al.
6,203,145 B1 3/2001 Jeanmaire et al.
(Continued)

FOREIGN PATENT DOCUMENTS

CN 1191807 9/1998
CN 101316712 12/2008
(Continued)

OTHER PUBLICATIONS

Liu; "Mathematical Handbook of Formulas and Tables"; 2nd Ed.; McGraw Hill; 1999; p. 29.

*Primary Examiner* — Huan H Tran
*Assistant Examiner* — Alexander D Shenderov
(74) *Attorney, Agent, or Firm* — Fabian VanCott

(57) ABSTRACT

An inkjet nozzle includes an aperture with a noncircular opening substantially defined by a polynomial equation. A droplet generator is also described which includes a firing chamber fluidically coupled to a fluid reservoir a heating resistor and a nozzle. The nozzle includes an aperture forming a passage from the firing chamber to the exterior of the droplet generator through a top hat layer. The nozzle is defined by a closed polynomial and has a mathematically smooth and mathematically continuous shape around aperture's perimeter wall, with two protrusions extending into the center of the aperture.

20 Claims, 11 Drawing Sheets

(58) Field of Classification Search
USPC ..... 347/47
See application file for complete search history.

(56) References Cited

U.S. PATENT DOCUMENTS

| | | | |
|---|---|---|---|
| 6,371,596 | B1 | 4/2002 | Maze |
| 6,527,369 | B1 | 3/2003 | Weber |
| 6,557,974 | B1 | 5/2003 | Weber |
| 6,860,588 | B1 | 3/2005 | Holstun et al. |
| 7,506,962 | B2 | 3/2009 | Murakami et al. |
| 2004/0051757 | A1 | 3/2004 | Holland |
| 2004/0155928 | A1 | 8/2004 | Clark et al. |
| 2006/0172227 | A1 | 8/2006 | Shaarawi et al. |
| 2007/0146437 | A1 | 6/2007 | Murakami et al. |
| 2008/0106574 | A1 | 5/2008 | Imahashi et al. |
| 2008/0291245 | A1 | 11/2008 | Takei |
| 2009/0002447 | A1 | 1/2009 | Takei et al. |
| 2009/0147056 | A1 | 6/2009 | Oikawa et al. |

FOREIGN PATENT DOCUMENTS

| | | | |
|---|---|---|---|
| EP | 0792744 | | 9/1997 |
| JP | 09131877 | | 5/1997 |
| JP | 09239986 | | 9/1997 |
| JP | 2008149516 | | 7/2008 |
| KR | 2008-0080589 | | 9/2008 |
| WO | WO-2009082391 | | 7/2009 |
| WO | WO-2011123120 | A1 | 10/2011 |

| | |
|---|---|
| A | 12.3000 |
| B | 12.4089 |
| C | 0.16810 |
| D | 1.32290 |

| | |
|---|---|
| A | 12.3000 |
| B | 12.4410 |
| C | 0.17230 |
| D | 1.32200 |

| | |
|---|---|
| A | 12.3000 |
| B | 12.4698 |
| C | 0.16800 |
| D | 1.35000 |

| | |
|---|---|
| A | 12.3000 |
| B | 12.4809 |
| C | 0.14800 |
| D | 1.37900 |

| | |
|---|---|
| A | 12.3000 |
| B | 12.5345 |
| C | 0.16200 |
| D | 1.38600 |

| | |
|---|---|
| A | 12.3000 |
| B | 12.6060 |
| C | 0.18000 |
| D | 1.39500 |

NONCIRCULAR INKJET NOZZLE

RELATED APPLICATIONS

This application is a continuation of U.S. application Ser. No. 13/386,368 filed on Jan. 24, 2012, which claims priority under 35 U.S.C. 371 to PCT/US2010/029450, having title "Noncircular Inkjet Nozzle", filed on Mar. 31, 2010, commonly assigned herewith, and hereby incorporated by reference.

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. Ideally, each ejection would result in a single ink droplet which travels along a predetermined velocity vector for deposition on the substrate. However, the ejection process may create a number of very small droplets which remain airborne for extended periods of time and are not deposited at the desired location on the substrate.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1C:
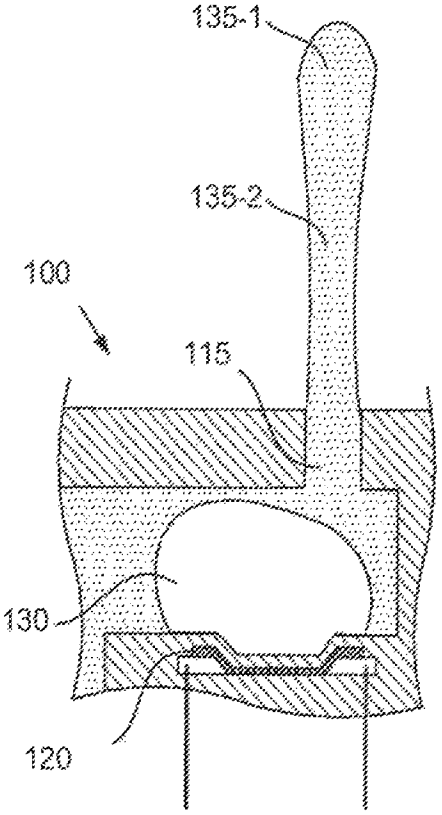
FIGS. 1A-1F are illustrative diagrams of the operation of a thermal inkjet droplet generator, according to one embodiment of principles described herein.
Figure 1B:
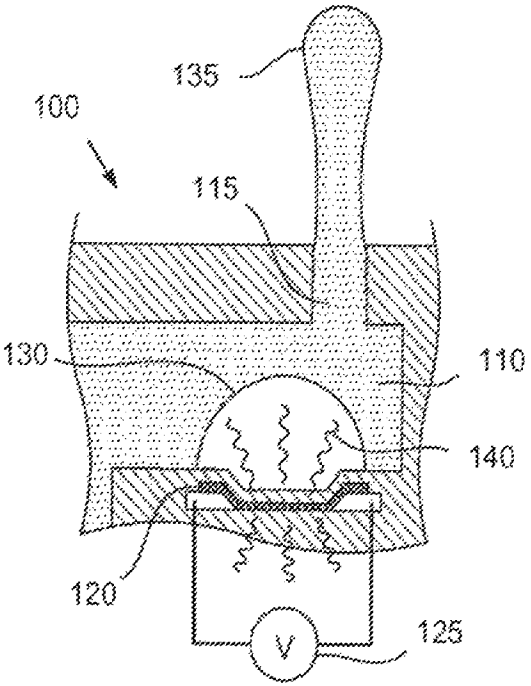

As discussed above, the inkjet printing process deposits fluids on a substrate by ejecting fluid droplets from a nozzle. Typically, the inkjet device contains a large array of nozzles which eject thousands of droplets per second during printing. For example, in a thermal inkjet, the printhead includes an array of droplet generators connected to one or more fluid reservoirs. Each of the droplet generators includes a heating element, a firing chamber and a nozzle. Fluid from the reservoir-fills the firing chamber. To eject a droplet, an electrical current is passed through a heater element placed adjacent to the firing chamber. The heating element generates heat which vaporizes a small portion of the fluid within the firing chamber. The vapor rapidly expands, forcing a small droplet out of the firing chamber nozzle. The electrical current is then turned off and the resistor cools. The vapor bubble rapidly collapses, drawing more fluid into the firing chamber from a reservoir.

Ideally, each firing event would result in a single droplet which travels along a predetermined vector at a predetermined velocity and is deposited in the desired location on the substrate. However, due to the forces which are applied to the fluid as it is ejected and travels through the air, the initial droplet may be torn apart into a number of sub-droplets. Very small sub-droplets may lose velocity quickly and remain airborne for extended periods of time. These very small sub-droplets can create a variety of problems. For example, the sub-droplets may be deposited on the substrate in incorrect locations which may lower the printing quality of the images produced by the printer. The sub-droplets may also be deposited on printing equipment, causing sludge build up, performance degradation, reliability issues, and increasing maintenance costs.

One approach which can be used to minimize the effects of airborne sub-droplets is to capture and contain them. A variety of methods can be used to capture the sub-droplets. For example, the air within the printer can be cycled through a filter which removes the airborne sub-droplets. Additionally or alternatively, electrostatic forces can be used to attract and capture the sub-droplets. However, each of these approaches requires additional equipment to be integrated into the printer. This can result in a printer which is larger, more expensive, consumes more energy, and is more maintenance intensive.

An alternative approach is to design the droplet generator to minimize velocity differences which tend to fear apart the ejected droplet. This directly reduces the formation of the airborne sub-droplets. We have discovered that the shape of the inkjet nozzle can be altered to reduce these velocity differences which have a tendency to fear apart a droplet during ejection. Specifically, inkjet nozzles which have a smooth profile with one or more protrusions into the center of the nozzle aperture reduce velocity differences within the ejected droplet and leverage viscous forces to prevent the droplet from being torn apart.

In the following description, for purposes of explanation, numerous specific details ere set forth in order to provide a thorough understanding of the present systems and methods. It will be apparent, however; to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1A:
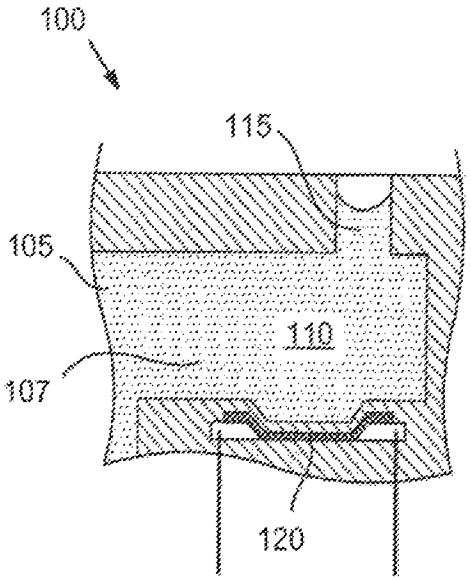

FIGS. 1A-1F show an illustrative time sequence of a droplet being ejected from the thermal inkjet droplet generator FIG. 1A is a cross-sectional view of one illustrative embodiment of a droplet generator (100) within a thermal inkjet printhead. The droplet generator (100) includes a firing chamber (110) which is fluidically connected to a fluid reservoir (105). A heating element (120) is located in proximity to the firing chamber (110). Fluid (107) enters the firing chamber (110) from the fluid reservoir (105). Under isostatic conditions, the fluid does not exit the circular nozzle (115), but forms a concave meniscus within the nozzle exit.

FIG. 18 is a cross-sectional view of a droplet generator (100) ejecting a droplet (135) from the firing chamber (110). According to one illustrative embodiment, a droplet (135) of fluid is elected from the firing chamber (110) by applying a voltage (125) to the heating element (120). The heating element (120) can be a resistive material which rapidly heats due to its internal resistance to electrical current. Part of the neat generated by the heating element (120) passes through the wall of the firing chamber (110) and vaporizes a small portion of the fluid immediately adjacent to the heating element (120). The vaporization of the fluid creates a rapidly expanding vapor bubble (130) which overcomes the capillary forces retaining the fluid within the firing chamber (110) and circular nozzle (115). As the vapor continues to expand, a droplet (138) is ejected from the circular nozzle (115).

In FIG. 1C, the voltage is removed from the heating element (120), which rapidly cools. The vapor bubble (130) continues to expand because of inertia effects. Under the combined influence of rapid heat loss and continued expansion, the pressure inside the vapor bubble (130) drops rapidly. At its maximum size, the vapor bubble (130) may have a relatively large negative internal pressure.

The droplet (135) continues to be forced from the firing chamber and forms a droplet head (135-1) which has a relatively high velocity and a droplet tail (135-2) which may have a lower velocity.

Figures 1D, 1E, 1F:
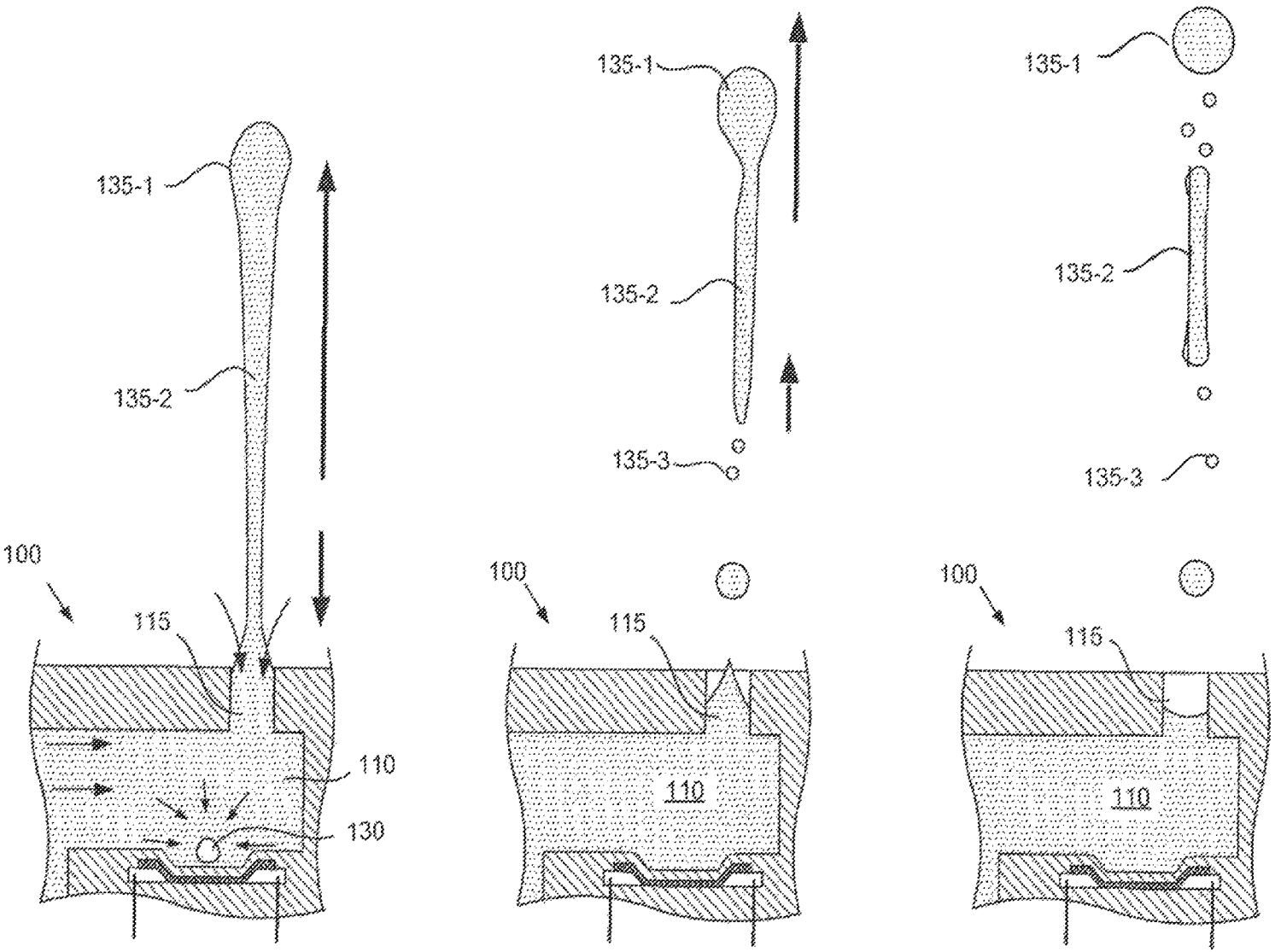

FIG. 1D shows the rapid collapse of the vapor bubble (130). This rapid collapse results in a low pressure in the firing chamber (110), which draws liquid into the firing chamber (110) from both the inlet port and the circular nozzle (115). This sudden reversal of pressure sucks a portion of the droplet tail (135-2) which has most recently emerged from the nozzle (115) back into the nozzle (115). Additionally, overall velocity of the droplet tail (135-2) is reduced as viscous attraction within the droplet tail resists the separation of the droplet (135). During this stage, the low pressure in the firing chamber (110) also tends to draw outside air into the circular nozzles (115).

The dark arrows to the right of the droplet (135) illustrate relative velocities of portions of the droplet during the bubble (130) collapse. The gap between the arrows indicates a stagnation point where the velocity of the droplet tall (136-2) is zero.

FIG. 1E shows the droplet (135) snapping apart at or near the stagnation point. The violence of the breakup of the droplet tail (135-2) creates a number of sub-droplets or satellite droplets (135-3). These sub-droplets (135-3) have relatively low mass and may have very low velocity. Even if the sub-droplets (135-3) have some velocity, it can be lost-relatively rapidly as the low mass sub-droplets (135-3) interact with the surrounding air. Consequently, the sub-droplets (135-3) may remain airborne for an extended period of time. As discussed above, the sub-droplets (135-3) may drift relatively long distances before contacting and adhering to a surface. If the sub-droplets (135-3) adhere to the target substrate, they typically cause print defects as they land outside of the target area. If the sub-droplets (135-3) land on printing equipment, they can create deposits which compromise the operation of the printing device and create maintenance issues.

The differences in velocities between the droplet tail (135-2) and the droplet head (135-1) can also cause separation and the generation of sub-droplets. As shown in FIG. 1E, the relatively large droplet head (135-1) has a higher velocity (as shown by the dark arrow to the left of the droplet head) than the droplet tail (135-2) (as shown by the shorter arrow to the left of the droplet tail). This can cause the droplet head (135-1) to pull away from the droplet tail (135-2).

FIG. 1F shows the separation of the droplet head (135-1) from the droplet tail (135-2) as a result of the velocity differences between the droplet head (135-1) and the droplet tail (135-2). This creates additional sub-droplets (135-3).

It has been discovered that the velocity differences which tend to shatter the droplets during ejection from an inkjet printhead can be reduced by altering the shape of the inkjet nozzle. Traditionally, the apertures of inkjet nozzles are circular. These circular nozzles are easy to manufacture and have a high resistance to clogging. However, as shown above, droplets ejected from the circular nozzles are have velocity differences which may tear apart the droplets during ejection. Specifically, the violent retraction of the tall of the droplet during the bubble collapse can shatter the trailing portion of the tail and the velocity differences between the head of the droplet and the leading portion of the tall can cause separation of the head and the tail. These shatter events produce small sub-droplets which can produce the reliability issues described above.

Figure 2:
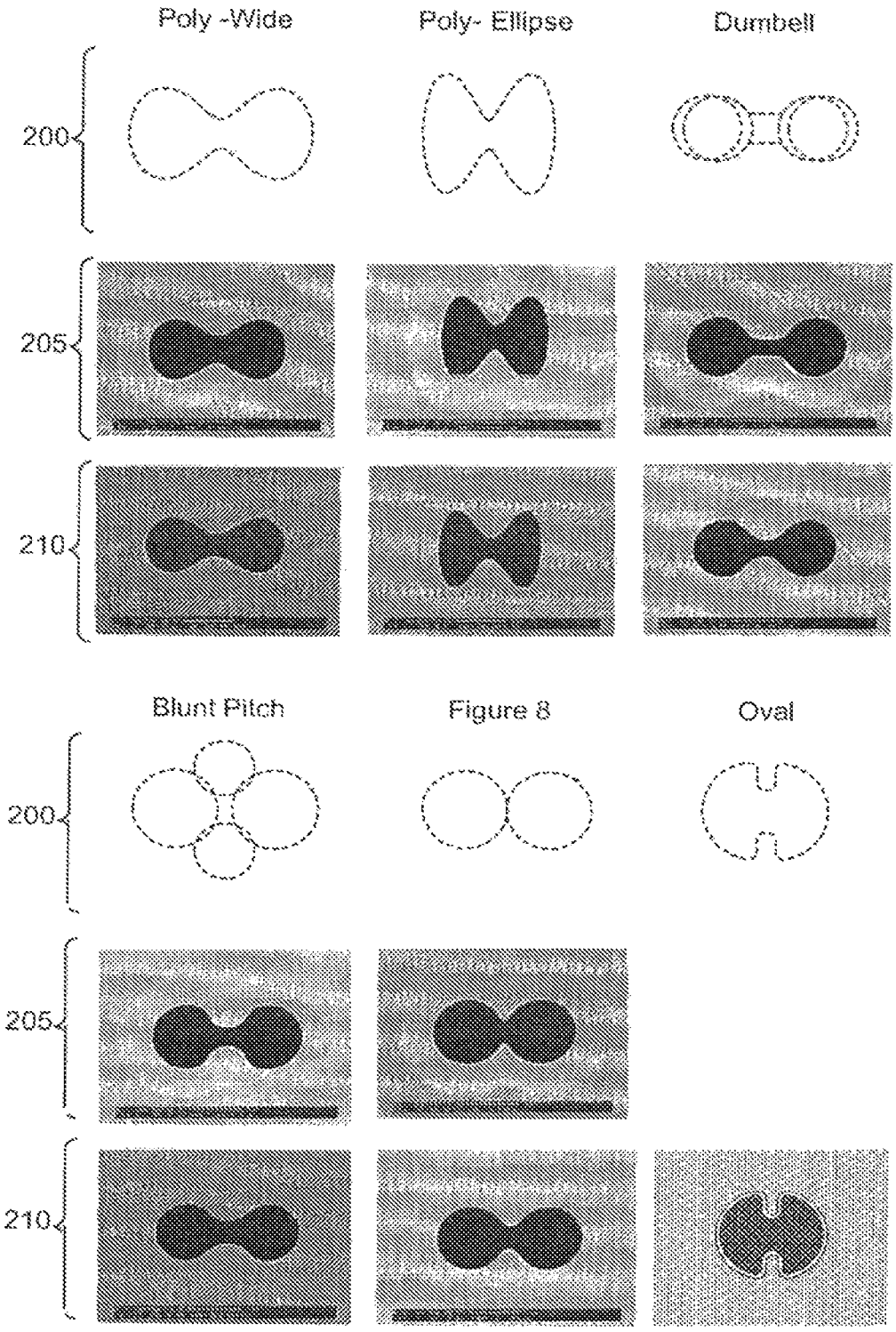
FIG. 2 is a diagram of illustrative nozzle geometries, according to one embodiment of principles described herein.

By using a non-circular shape for the inkjet nozzle, these velocity differences can be reduced. FIG. 2 shows six non-circular nozzle aperture geometries which were constructed and tested to ascertain their performance characteristics. These six shapes are: the poly-wide, the poly-ellipse, the dumbbell, the blunt pinch, the figure 8 and the oval. The theoretical outlines (200) of the shapes are shown in the first row of FIG. 2. The theoretical outlines (200) are shown as dashed lines which represent geometric shapes which form the foundation for the nozzle shapes. A first implementation (205) of the nozzle apertures with a counter bore is shown in the second row and a second implementation (210) of the nozzles without a counter bore is shown in the third row. As the geometric shapes are convened into outlines and the nozzles (205, 210) are constructed, the geometric shapes can be altered. For example, the "figure 8" theoretical outline includes two overlapping circles. As implemented, the "figure 8" nozzle has a much smoother profile.

Figure 3:
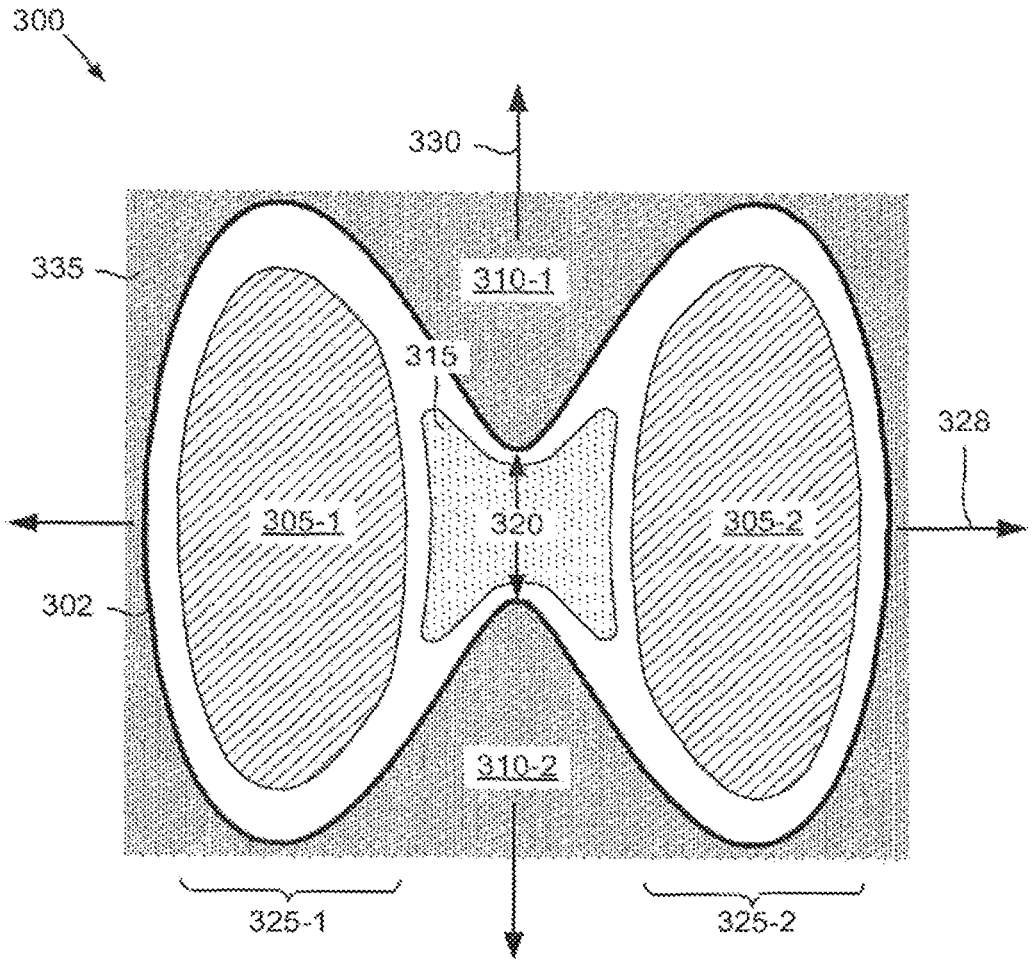
FIG. 3 is a diagram of an illustrative nozzle geometry, according to one embodiment of principles described herein.

Based on the test results, the poly-ellipse design was selected for further testing. FIG. 3 shows an illustrative diagram of a poly-ellipse nozzle (300). According to this illustrative embodiment the shape of the poly-ellipse aperture (302) is defined by a fourth degree polynomial shown below.

$$(DX^2+CY^2+A^2)^2-4A^2X^2=B^4 \qquad \text{Eq. 1}$$

As shown in the illustrative example shown in FIG. 3, this multivariable polynomial generates a closed shape which has a mathematically smooth and mathematically continuous outline. As used in the specification and appended claims, the term "mathematically smooth" refers to a class of functions which have derivatives of all applicable orders. The term "mathematically continuous" refers to a function in which small changes in the input result in small changes in the output. The term "closed" refers to functions which circumscribe an area of a plane or other graphing space such that a path from the interior of the enclosed area to the exterior must cross a boundary defined by the function. The aperture shape shown in FIG. 3 is generated by a single equation with general form shown in Eq. 1. Specifically, the aperture shape is not created by joining lines generated by disparate equations in a piecewise fashion.

It has been discovered that nozzle apertures with relatively smooth profiles are more efficient in allowing fluid to pass out of the firing chamber. Specifically, the nozzles with sharp profile changes, such as the oval profile illustrated in FIG. 2, are less effective per unit area in generating a droplet of a given size. For example, to generate a 9 μg droplet, the oval profile would require a larger cross sectional area than the poly-ellipse profile which has smoother contours.

To generate a shape which is similar to that shown in FIG. 3, the following constants can be substituted into Equation 1 above.

TABLE 1

| | |
|---|---|
| A | 12.3000 |
| B | 12.5345 |
| C | 0.16200 |
| D | 1.38600 |

This poly-elliptical shape defines a noncircular aperture (302) which is used in the nozzle (300). The noncircular aperture (302) has two elliptical lobes (325-1, 325-2). Between the elliptical lobes (325), two protrusions (310-1, 310-2) extend toward the center of the nozzle (300) and create a constricted throat (320). A measurement across the narrowest portion of the throat is called the "pinch" of the throat (320).

The resistance to fluid flow is proportional to the cross-sectional area of a given portion of the nozzle. Parts of the nozzle which have smaller cross sections have higher resistance to fluid flow. The protrusions (310) create an area of relatively high fluid resistance (315) in the center portion of the aperture (302). Conversely, the lobes (325-1, 325-2) have much larger cross-sections and define regions of lower fluid resistance (305-1, 305-2).

The major axis (328) and the minor axis (330) of the aperture (302) are illustrated as arrows which pass through the poly-elliptical nozzle (300). The major axis (328) bisects the elliptical lobes (325). The minor axis (330) bisects the protrusions (310) and passes across the throat (320) region of the aperture (302). According one embodiment, the envelope (335) of the aperture (302) is illustrated by grey rectangle which bounds the aperture (302) on both the major and minor axes (328, 330). According to one illustrative embodiment, the envelope (338) of the aperture (302) may be approximately 20 microns by 20 microns. This relatively compact size allows the nozzle (300) to be used in print head configurations which have approximately 1200 nozzles per linear inch.

Figure 4A:
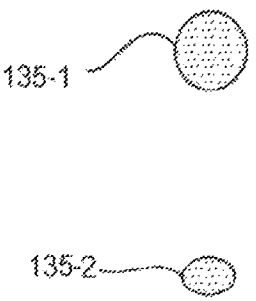
FIGS. 4A-4H is a diagram of illustrative droplet generators ejecting droplets through noncircular nozzles, according to one embodiment of principles described herein.
Figure 4A:
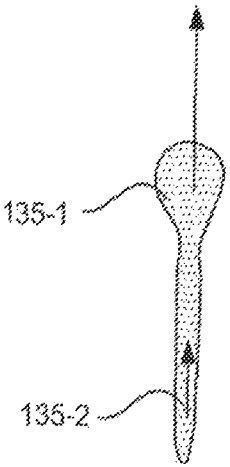
Figure 4A:
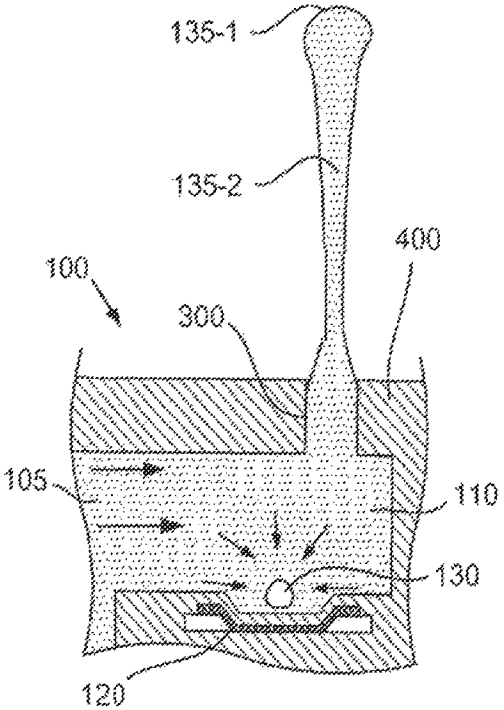
Figure 4B:
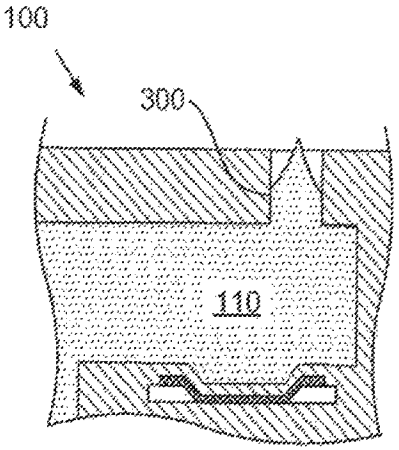
Figure 4C:
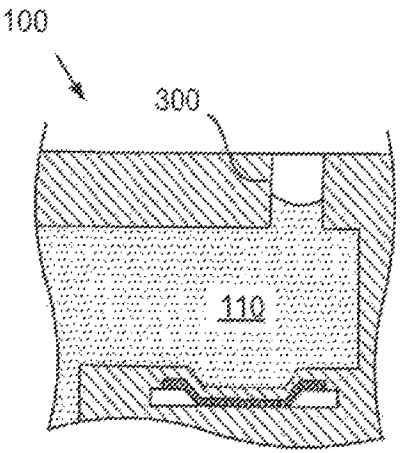

FIGS. 4A-C describe the ejection of a fluid droplet (315) from a droplet generator (100) which includes a poly-ellipse nozzle (300). As shown in FIG. 4A, the droplet generator (100) includes a firing chamber (110) which is fluidically connected to a fluid reservoir (105). A nozzle (300) with a poly-elliptical aperture forms a passage through the top hat layer (400). A heating resistor (120) creates a vapor bubble (130) which rapidly expands to push a droplet (315) out of the firing chamber (110) and through the nozzle (300) to the exterior. As discussed above, higher volumes and velocities of fluid emerge from the more open cross-sections of the aperture (302). Consequently, the droplet (135) emerges more quickly from the open cross-sections (305-1, 305-2, FIG. 3) of the lobes (325-1, 325-2). The restricted cross-section in the throat (320) of the poly-ellipse aperture (302) has higher resistance to fluid flow. According to one illustrative embodiment the tail of the droplet (135-2) can be automatically and repeatably centered at the throat area (320) because of the inertia, viscous and capillary forces between the tail (135-2) and the throat (320). There are several advantages of having the tail of the droplet (135-2) centered at the throat area (320). For example, centering the tail (135-2) over the throat (320) may provide a more repeatable separation of the tail (135) from the body of liquid which remains in the firing chamber (110, FIG. 1). This will keep the tall (135-2) aligned with head of the droplet (135-1) and improve the directionality of the droplet (135).

Another advantage of centering the tail (135-2) over the throat (320) is that as the vapor bubble collapses, the higher fluid resistance of throat (320) reduces the velocity difference in the tail (135-2). This can prevent the droplet (135) from being violently torn apart as the front portion of the droplet (135-1) continues to travel at approximately 10 m/s away from the nozzle (300) and a portion of the tail (135-2) is jerked back inside the firing chamber (110, FIG. 1). Instead, surface tension forms an ink bridge across the pinch. This ink bridge supports the tail (135-2) while the ink is being pulled back into the bore during the collapse of the vapor bubble. The fluid is drawn in from lobes (325), forming a meniscus (405) which continues to be drawn into the firing chamber (110, FIG. 1).

As the vapor bubble (130) collapses, fluid is drawn into the firing chamber (110) from both the inlet of the fluid reservoir (105) and the nozzle (300). However, as illustrated in FIG. 4B, the centering of the tail (135-2) over the throat and the reduction in velocity differences within the droplet (135) reduces the likelihood that sub-droplets (153-3, FIG. 1E) will be produced. If these relative velocities are similar enough in magnitude and direction, the surface tension forces will draw the tail (135-2) up into the droplet head (135-1). This single droplet (135) will then continue to substrate and land on or near the target location. However, as shown in FIG. 4C, the velocity difference between the droplet head (135-1) and the droplet tail (135-2) in this example are not sufficiently small to allow the tail (135-2) to coalesce with the head (135-1). Instead, two droplets are formed: a larger head droplet (135-1) and a smaller tail droplet (135-2).

According to one illustrative embodiment, the droplet generator and its nozzle can be designed to produce repeatably produce droplets with a mass in the range of 6 nanograms to 12 nanograms. For example, the droplet generator and nozzle may be configured to produce droplets with a mass of 9 nanograms.

Figure 4D:
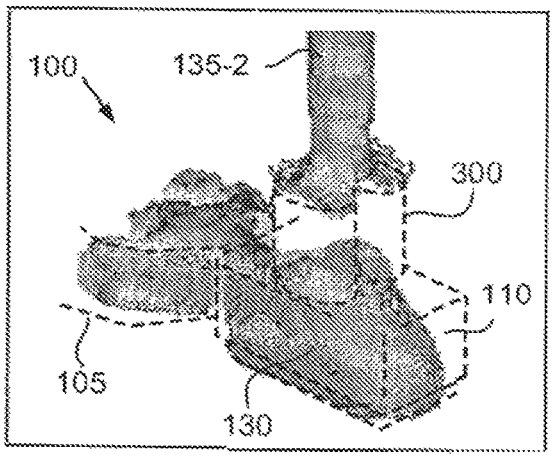
Figure 4E:
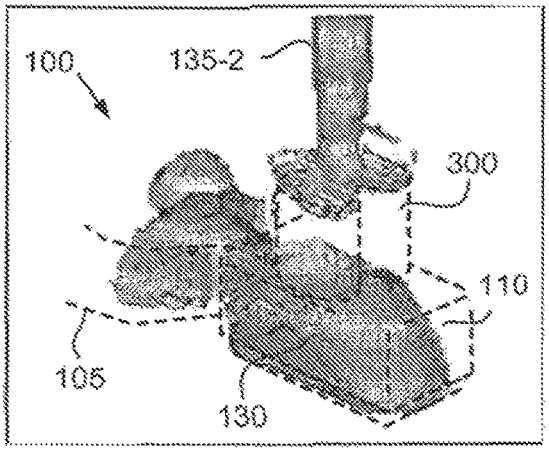
Figure 4F:
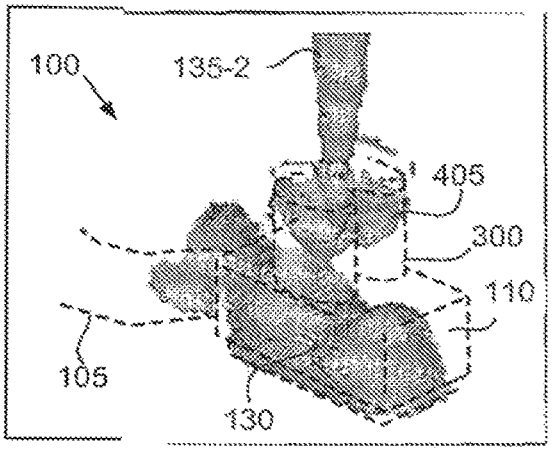

FIGS. 4D-4H focus in more detail on the vapor bubble collapse, the tail separation, and the refraction of the meniscus into the firing chamber. In FIGS. 4D-4H, the dotted lines represent the interior surfaces of the droplet generator (100). The textured shapes represent liquid/vapor interfaces. FIG. 4D shows the vapor bubble (130) near its maximum size. The vapor bubble (130) fills most of the firing chamber (110) and extends out into the ink reservoir (106). The tail (135-2) of the droplet extends out of the nozzle (300). FIG. 4E shows the vapor bubble (130) beginning to collapse and the tail of the droplet beginning to thin. FIG. 4F shows the vapor bubble (130) continuing to collapse and a meniscus (405) beginning to form in the nozzle (300) as the collapsing bubble (130) draws air from the exterior into the nozzle (300). As can be seen in FIG. 4F, the meniscus (405) forms two lobes which correspond to the two lobes of the poly-ellipse nozzle (300). The tail (135-2) remains centered over the center of the nozzle (300). As discussed above, position of the tail (135-2) at separation can influence the trajectory of the droplet.

Figure 4G:
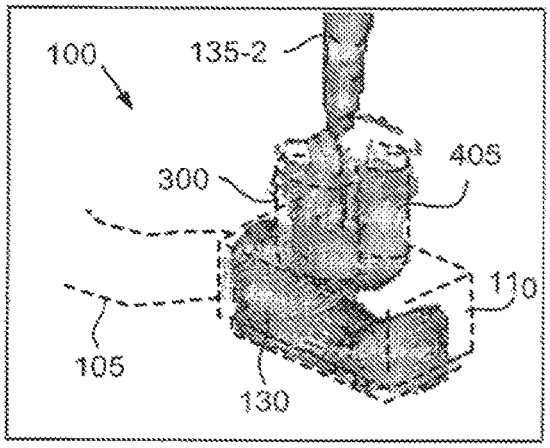

FIG. 4G shows that the vapor bubble (130) has entirely retracted from the ink reservoir (105) and is beginning to divide into two separate bubbles. The meniscus (405) continues to deepen into the hung chamber (101), indicating that air is being drawn into the firing chamber (110). The tail (135-2) is separating from nozzle (300) at this point and is detaching from neutral position over the center of the nozzle (300).

Figure 4H:
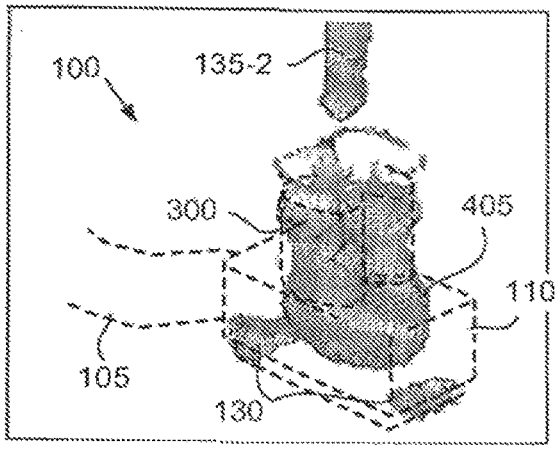

FIG. 4H shows the tail (135-2) has completely separated from the nozzle (400). The surface tension in the tail (135-2) has begun to draw the bottom most portions of the tail up into the main portion of the fail. This results in the tail (135-2) having a slightly bulbous end. The vapor bubble (130) has collapsed into two separate bubbles which are in the corners of the firing chamber (110). The meniscus (405) extends well into the firing chamber (110). As discussed above, there a reduced number of satellite droplets during the ejection of the droplet from the droplet generator (100) which includes a poly-ellipse nozzle (300).

Figure 5B:
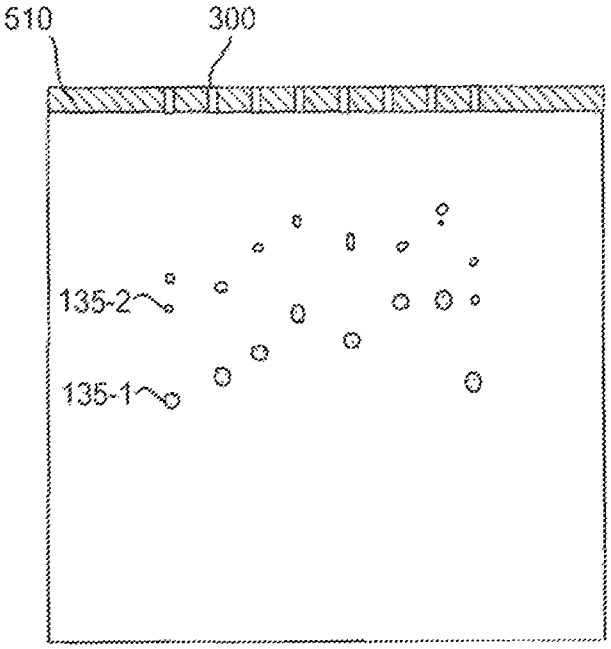
FIGS. 5A and 5B are illustrative diagrams of droplets ejected from circular nozzles and noncircular nozzles, respectively, according to one embodiment of principles described herein.
Figure 5A:
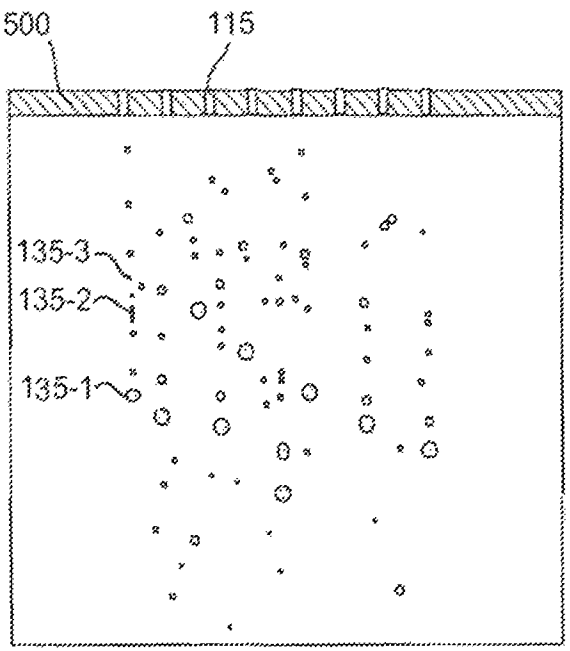

FIGS. 5A and 5B are diagrams which illustrate actual images of the ejection of ink droplets from an array of circular nozzles, as shown in FIGS. 1A-1F, and ink droplets which are ejected from an array of poly-ellipse nozzles, as shown in FIGS. 4A-4F. As can be seen in FIG. 5A, the droplets ejected from the circular nozzles (115) in a printhead (500) are shattered into numerous different sub-droplets (135-3). This creates a mist of droplets (135) of various sizes. As discussed above, sub-droplets (135-3) which lower masses lose velocity quickly and can remain airborne for long periods of time.

FIG. 5B is a diagram of the ejection of droplets (135) from poly-ellipse nozzles (300) in a printhead (510). In this case, the droplets (135) have consistently formed only head droplets (135-1) and tail droplets (135-2). There is little evidence of smaller sob-droplets. The head droplet (135-1) and the tail droplets (135-2) may merge in flight and/or may impact the same area of the substrate.

Figure 6A:
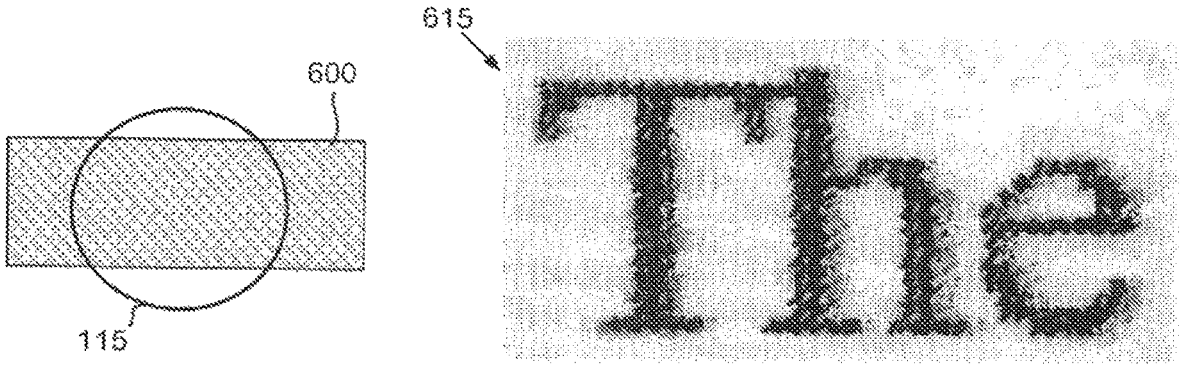
FIGS. 6A and 6B are illustrative diagrams of images created by an inkjet printhead with circular nobles and an inkjet printhead with noncircular nozzles, respectively, according one embodiment of principles described herein.
Figure 6B:
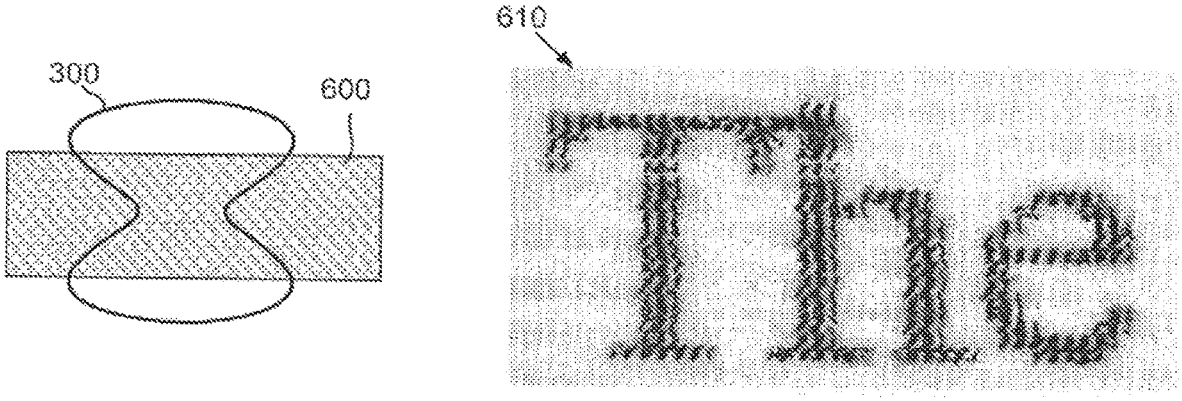

FIGS. 6A and 6B are illustrative diagrams which contrast the print quality effects of circular nozzles and the illustrative poly-ellipse nozzles. The left hand side of the FIG. 6A illustrates the circular nozzle (115) and the relative orientation and size of the underlying resistor. The right hand side of the FIG. 6A is a photograph (615) of a section of text produced using the circular nozzles. The text is the word "The" in four point font. Clearly visible in the photograph (615) is the blurring of the text edges produced by medium mass sub-droplets with a slower velocity. These sub-droplets to not impact in the desired locations and cause blurring of the image. As discussed above, the lowest mass sub-droplets may not ever contact the substrate.

The left hand side of FIG. 6B shows a poly-ellipse nozzle (300) which is perpendicular to the underlying heating resistor (600). As shown in the right hand photograph (610), the same word in the same font was printed with using the poly-ellipse nozzle (300) design. The print quality produced by the poly-ellipse nozzle (300) is significantly better with respect to edge crispness than the circular nozzle (115). Clearly absent are the relatively small dots which indicate droplet breakup. Another result of larger droplet sizes is that the droplets are placed with greater accuracy. The interior of the letters of the word "The" show a significant amount of light/dark texture or "graininess" in the interior of the letters. This is a result of larger droplet sizes which travel more accurately to a target location. For example, if each ejection cycle results in two drops, the head droplet and the tail droplet may both land in the same location. This can result white space between the target locations.

A variety of parameters could be selected or altered or to optimize the performance of a poly-elliptical nozzle (300). These parameters reflect the wide range of factors which may affect the performance of an inkjet nozzle. In addition to the shape of the nozzle, the characteristics of the ink can affect the performance of the nozzle. For example, the viscosity, surface tension, and composition of the ink can affect the nozzle performance.

Figure 7A:
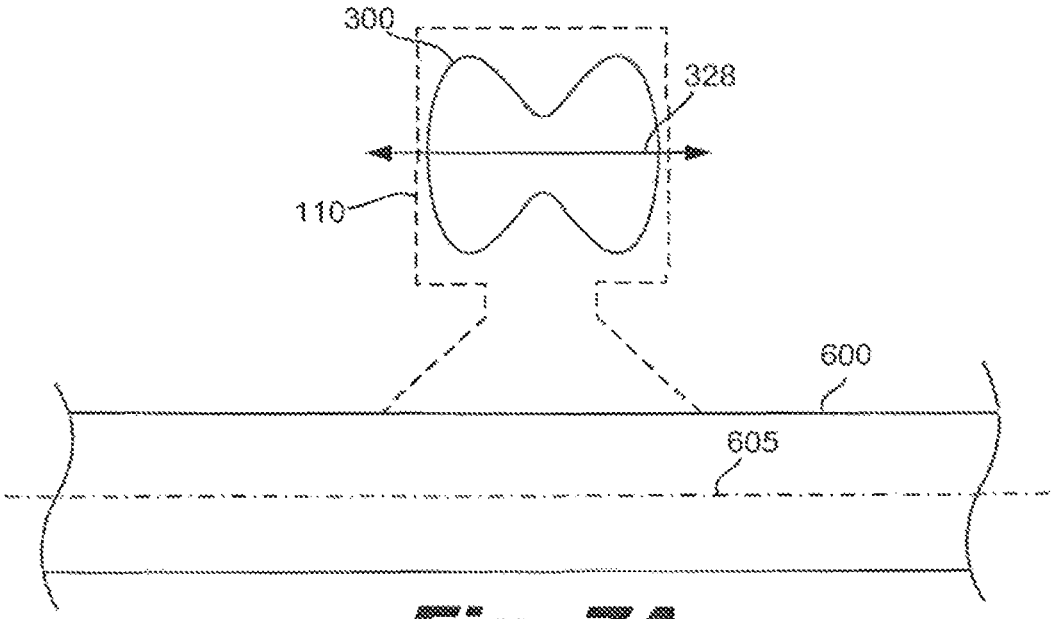
FIGS. 7A and 7B are illustrative diagrams of an inkjet nozzle and an underlying resistor, according to one embodiment of principles described herein.
Figure 7B:
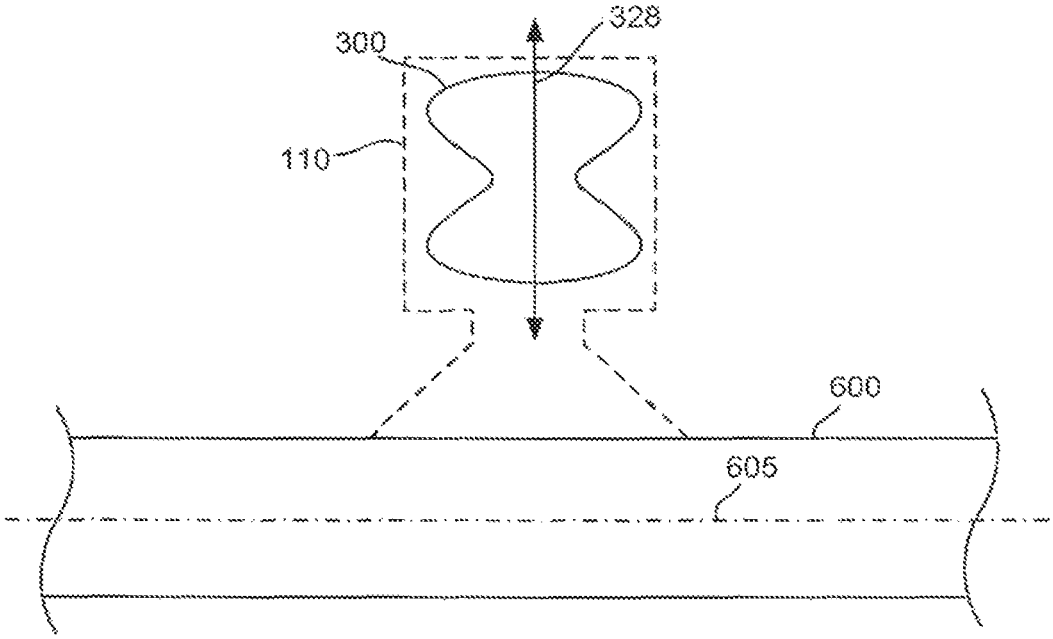

FIGS. 7A and 7B illustrate one parameter which can be adjusted to alter the performance of the nozzle. Specifically, the orientation of a feed slot (600) with respect to the nozzle (300) can be adjusted. The feed slot (600) is an aperture which forms a fluidic connection between a primary ink reservoir and a plurality of firing chambers (110) which are arranged along the sides of the feed slot (600). According to one illustrative embodiment shown in FIG. 7A, the major axis (328) of the nozzle (300) is parallel to the major axis (605) of the feed slot (605). In this embodiment, both of the lobes of the poly-elliptical nozzle (300) are equally distant from the feed slot (600) and exhibit approximately the same behavior. However, FIG. 7B shows the major axis (605) of the feed slot (600) and major axis (328) of the nozzle (300) in a perpendicular orientation. In this configuration, one of the lobes is located within the firing chamber at a different distance from the feed slot (600) than the other lobe. This results in an asymmetric fluid behavior in the two lobes. In some applications, this can be advantageous.

A variety of other parameters can be adjusted within the droplet generator. For example, the size and shape of the heating resistor (600) can influence the geometry of the vapor bubble during a firing sequence. In turn, the vapor bubble influences the characteristics of the ejected droplets.

Figure 8:
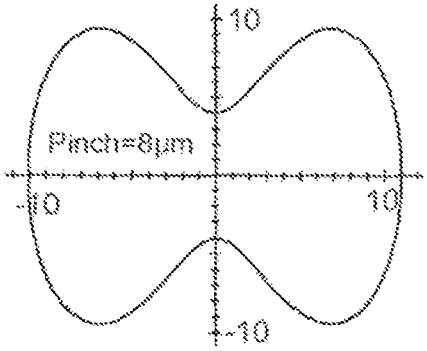
FIG. 8 includes diagrams of a number of illustrative aperture geometries, according to one embodiment of principles described herein.
Figure 8:
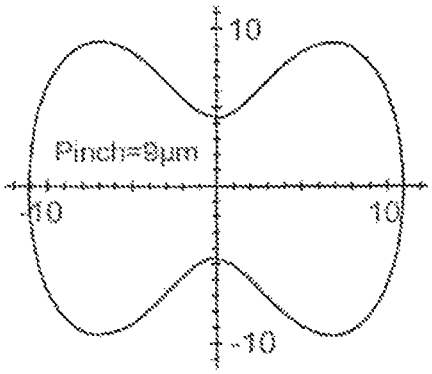
Figure 8:
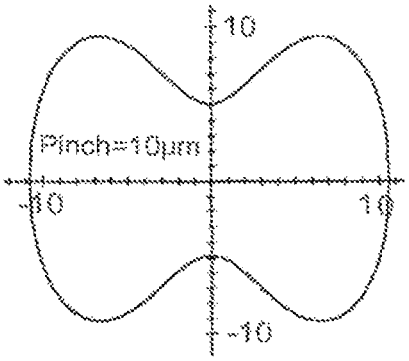
Figure 8:
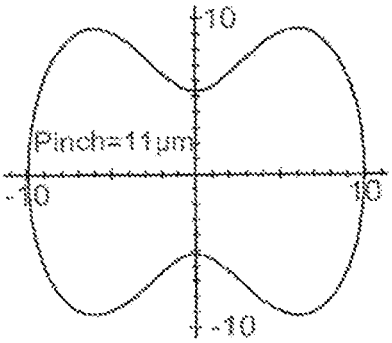
Figure 8:
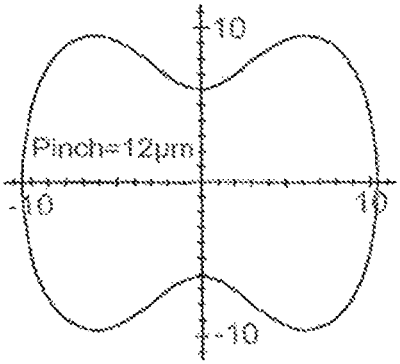
Figure 8:
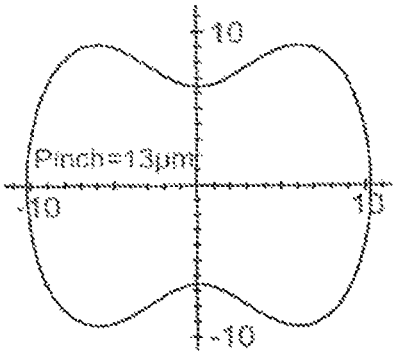

Another parameter that can be adjusted is the geometry of the poly-ellipse profile, FIG. 8 includes a number of illustrative poly elliptical profiles which could be created by adjusting the parameters in Eq. 1. Each illustrative example in FIG. 8 includes a profile with the pinch of the throat and a chart listing the parameters used in Eq. 1 to generate the geometry. The profile is superimposed on a graph which shows X and Y distances in microns. For example, the illustrative example in the upper left hand corner the outline of the poly-ellipse profile extends along the X axis from approximately 10 microns to −10 microns. The pinch at the narrowest point in the throat is 8 microns.

Other illustrative examples have increasingly larger pinches. The lower right hand example has the most open profile with a pinch of 13 microns. The more open profiles have greater fluid flow, are less likely to be obstructed and are easier to clear it an obstruction occurs. However, the wider the throat of the profiles, the smaller effect the protrusions have in reducing droplet break up.

For each graph there is corresponding table with the constants which can be substituted into Eq. 1 to generate the illustrated shape. These constants are only illustrative examples. A variety of other constants could fee used to generate a shape with the same throat pinch. For example, a 12 micron throat pinch could be generated using the bottom left hand table in FIG. 8. However, a similar shape with a 12 micron throat pinch could be generated by substituting the following constants into Eq. 1.

TABLE 2

| | |
|---|---|
| A | 12.3000 |
| B | 12.420094 |
| C | 0.082 |
| D | 1.455 |

In comparing Table 2 to the bottom right hand table in FIG. 8, it is clear that the various constants can be increased, decreased, or remain the same while still producing the same throat pinch. For example, constant A has remained the same, B has slightly decreased, C has decreased by almost half of value shown in FIG. 8, and D has increased.

These constants may be selected from: a range of values to create the desired shape. For example, A may have a range of approximately 9 to 14; B may have a range of approximately 9 to 14; C may have a range of approximately 0.001 to 1; and D may have a range of approximately 0.5 to 2. In another embodiment. A may have a range from, approximately 12.0 to 13.0; B may have a range of approximately 12.0 to 13.0; C may have a range of approximately 0.001 to 0.5; and D may have a range of approximately 1 to 2.

The constants may be selected such that the resulting nozzle defined by the polynomial produces droplets with a desired drop mass. For example, the pinch may range from 3 and 14 microns and the drop mass may range from 4 nanograms to 15 nanograms. As discussed above, a variety of constant values may be selected to generate the desired geometry. Additionally, a number of other equations could be used to generate pinched elliptical forms.

Figure 9A:
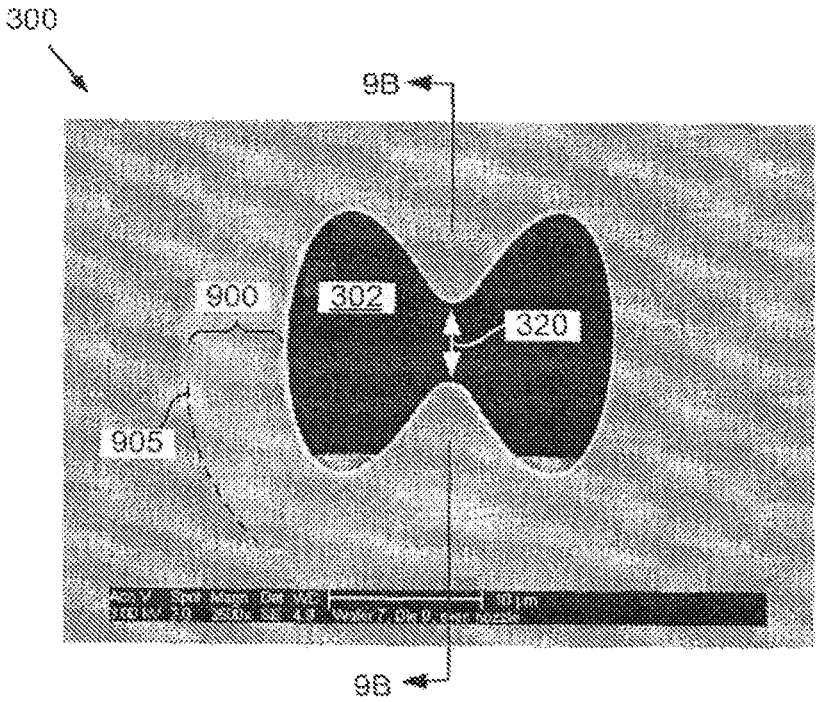
FIGS. 9A and 9B are diagrams of an illustrative noncircular inkjet nozzle, according to one embodiment of principles described herein.
Figure 9B:
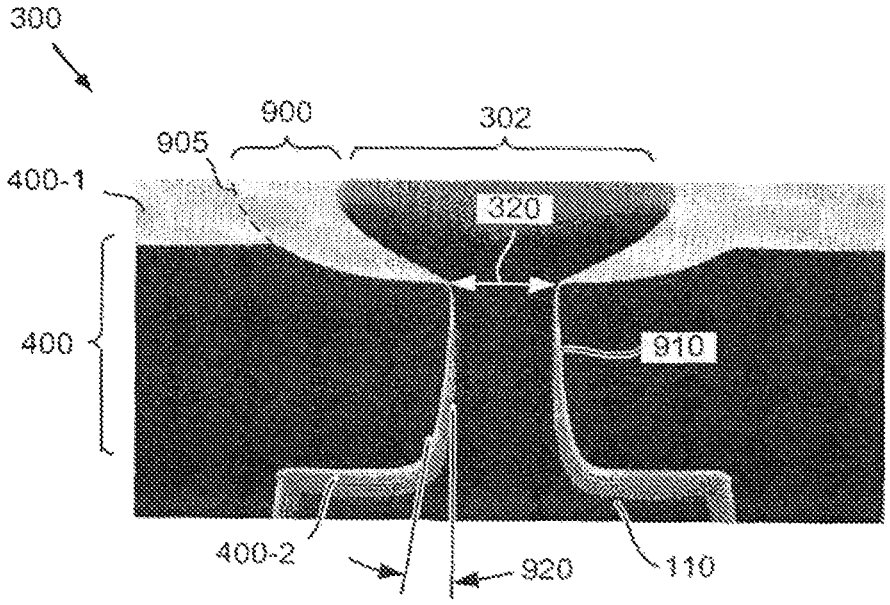

FIGS. 9A-9B are photographic images of one illustrative embodiment of a poly-elliptical nozzle. FIG. 9A is a plan view and shows the poly-elliptical nozzle (300) with a throat (320). In this illustrative embodiment, a counter bore (900) has been formed. A dashed line (905) marks the beginning of the counter bore (900). As used in the specification and appended claims the term "counter bore" refers to relatively shallow depression or other cutout-region around the perimeter of the nozzle (300). This counter bore (900) may have a variety of shapes, widths, and sizes.

FIG. 9B is a cross sectional diagram of the nozzle (300) along line 9B-9B in FIG. 9A. The line 9B-9B passes through the throat (320) of the nozzle (300). The cross section shows the nozzle (300) passing through the top hat layer (400). The top hat layer (400) includes an interior surface (400-2) which forms the roof of the firing chamber (110) and an exterior surface (400-1) which forms the exterior surface of the droplet generator. According to one illustrative embodiment, the top hat layer (400) is formed from SU-8, an epoxy-based negative photoresist. The top hat layer (400) may be formed in a variety of thicknesses. For example, top hat layer (400) may be 20 microns in thickness.

In this illustrative embodiment, the counter bore (900) is a shallow, dish-shaped depression. The counter bore (900) may serve a number of functions, including removing any burrs or other manufacturing defects from the upper perimeter of the profile. Additionally, the perimeter walls (910) which form the nozzle (300) may be tapered. In this illustrative embodiment, the perimeter walls (910) of the nozzle (300) flare outward at approximately a 12 degree angle. In other embodiments, the flare angle may range from 5 to 15 degrees. Consequently, the nozzle throat (320) is wider at interior surface (400-2) and narrows before entering the counter bore (900).

The counter bore (900) and taper (920) of the aperture (302) may be formed in a number of ways, including those described in U.S. Pat. No. 7,585,618 to Shaarawi et al. filed on Jan. 31, 2005, which is incorporated herein by reference in its entirety.

In sum, a poly-ellipse nozzle defined by a polynomial forms an aperture with a smooth and continuous outline with two projections extending into the center of the aperture to form a throat. This nozzle geometry slows fluid passing through the center of the aperture and minimizes velocity differences within the elected droplet. This reduces break up of ejected droplets and increases the repeatability and precision of the droplet trajectory. The nozzle geometry also allows the tail to be centered over the throat during separation of the droplet from the droplet generator. This results a more gentle separation of the droplet tail from the droplet generator and less violent refraction portions of the tail back into firing chamber during bubble collapse. This reduces the break up of the tall during separation and prevents the tail from skewing the droplet trajectory.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A nozzle comprising:

an aperture with a perimeter wall being a noncircular opening and defined by a mathematically smooth and mathematically continuous closed polynomial, the aperture having two protrusions extending into the aperture.

2. The nozzle of claim 1, in which the polynomial is defined by a fourth order polynomial equation.

3. The nozzle of claim 2, in which the polynomial equation has a general form of: $(DX^2+CY^2+A^2)^2-4A^2X^2=B^4$, where A, B, C and D are constants which define the shape of the polynomial.

4. The nozzle of claim 3, in which constants in the polynomial equation comprise:

A having a range of approximately 9 to 14 microns;

B having a range of approximately 9 to 14 microns;

C having a range of approximately 0.001 to 1; and

D having a range of approximately 0.5 to 2.

5. The nozzle of claim 3, in which constants in the polynomial equation comprise:

A having a range of approximately 12.0 to 12.5 microns;

B having a range of approximately 12.0 to 13.0 microns;

C having a range of approximately 0.001 to 0.5; and

D having a range of approximately 1 to 2.

6. The nozzle of claim 1, in which the two protrusions extending into the aperture form a throat, the throat being configured to restrict fluid flow through a central portion of the aperture.

7. The nozzle of claim 6, in which the throat has a pinch of between 3 and 14 microns and a nozzle envelope is approximately 20 microns by 20 microns.

8. The nozzle of claim 1, in which the nozzle is to generate a droplet having a mass between 4 nanograms and 15 nanograms.

9. The nozzle of claim 1, in which a major axis of nozzle is parallel to a major axis of a feed slot fluidically coupled to the nozzle.

10. The nozzle of claim 1, further comprising a counter bore.

11. The nozzle according to claim 1, in which a perimeter wall of the aperture comprises a taper between 5 and 12 degrees.

12. A droplet generator comprising:

a firing chamber fluidically coupled to a fluid reservoir via a feed slot;

a heating resistor; and a nozzle comprising an aperture forming a passage from the firing chamber to the exterior of the droplet generator, the nozzle being defined by a closed polynomial having a mathematically smooth and mathematically continuous shape around a perimeter wall of the aperture, the nozzle having two protrusions extending into the center of the aperture.

13. The droplet generator of claim 12, in which the nozzle comprises:

a counter bore, the counter bore being formed in an exterior surface of a top hat layer; and a taper, the taper being formed in the aperture's perimeter wall such that the width of the nozzle is greater at an interior surface of the top hat layer and narrows before entering the counter bore on the exterior surface of the top hat layer; the taper being between 5 and 15 degrees.

14. The droplet generator of claim 13, in which the two protrusions extending to the center portion of the aperture form a throat configured to restrict fluid flow in the central portion of the aperture such that the velocity difference between a head portion of an ejected droplet and a tail portion of an ejected droplet is reduced.

15. The droplet generator of claim 14, wherein, during ejection of an ink droplet from the nozzle, the throat causes a tail of the ejected droplet is centered over the throat when the ejected droplet separates.

16. A nozzle comprising:

an aperture defined by a perimeter wall around a noncircular opening, the shape of the perimeter wall defined by a mathematically smooth and continuous closed polynomial.

17. The nozzle of claim 16, wherein two protrusions of the perimeter wall extend into the aperture.

18. The nozzle of claim 17, wherein the two protrusions extending into the aperture form a throat to restrict fluid flow through a central portion of the aperture.

19. The nozzle of claim 16, wherein the polynomial is defined by a fourth order polynomial equation.

20. The nozzle of claim 16, wherein the aperture's perimeter wall comprises a taper between 5 and 12 degrees.

* * * * *